US006191743B1

(12) United States Patent
Jones et al.

(10) Patent No.: US 6,191,743 B1
(45) Date of Patent: Feb. 20, 2001

(54) MULTIPLE ANTENNA PORTS FOR ELECTRONIC DEVICES

(75) Inventors: Jeffrey L. Jones, Orem; Sy Prestwich, West Jordan; Steven LoForte, Midvale; Kurt Stewart, Lehi; David Moore, Riverton; John M. Wheeler, Salt Lake City, all of UT (US)

(73) Assignee: 3Com Cororation, Santa Clara, CA (US)

( * ) Notice: Under 35 U.S.C. 154(b), the term of this patent shall be extended for 0 days.

(21) Appl. No.: 09/543,037

(22) Filed: Apr. 5, 2000

(51) Int. Cl.[7] ..... H01Q 1/24
(52) U.S. Cl. ..... 343/702; 455/90
(58) Field of Search ..... 343/702, 720; 455/90, 97, 14, 15, 128, 129

(56) References Cited

U.S. PATENT DOCUMENTS 6,031,495 * 2/2000 Simmons et al. ..... 343/702

* cited by examiner

*Primary Examiner*—Tan Ho
(74) *Attorney, Agent, or Firm*—Workman, Nydegger & Seeley

(57) ABSTRACT

An apparatus for facilitating the various placement of an antenna within a wireless transceiver device such as a wireless personal data assistant is presented. Such an apparatus enables the relocation of an antenna device in accordance with a user preferred configuration. The relocation of the antenna device does not effect the overall performance and does not require further termination of unused antenna configurations. Such an apparatus facilitates the preferred placement of an antenna in accordance with a user's hand preference (e.g., right handedness verses left handedness).

16 Claims, 3 Drawing Sheets

MULTIPLE ANTENNA PORTS FOR ELECTRONIC DEVICES

BACKGROUND OF THE INVENTION

1. The Field of the Invention

The present invention relates generally to antennas as they are coupled to mobile electronic devices. More specifically, the present invention applies to user-selectable placement of an electronic device's antenna.

2. Related Applications

Personal portable electronics have become increasingly smaller in size while becoming more sophisticated in performance and complexity. One such ubiquitous portable device has commonly become known as the personal data assistant (PDA). The PDA has become widely acceptable because of its convenient form factor and its ability to store and organize a user's calendar, address book, and various other scheduling and note taking functions. While the size of PDAs continues to evolve, one such form factor is typically about the size of a standard shirt pocket.

Because of the size and increased capabilities of a PDA, it has become one of the electronic devices of choice to be carried by a user. Other such electronic devices, such as wireless-based devices, (e.g., cellular telephones, pagers) are also generally carried by a user. It is understandable that such interactive or two-way wireless devices provide addressable messaging platforms through which a user may interact in an untethered environment. However, traditional interactions with such wireless devices such as cellular telephones and pagers provide a very small bandwidth conduit through which limited information may pass. Furthermore, the traditional visual display presented to a user via a cellular telephone or numeric pager, has heretofore been largely alphanumeric in nature.

While the onset of the information age has wetted the appetite for the exchange of more complex and sophisticated information, traditional cellular and paging form factors have not been conducive to the presentment of such sophisticated data information, namely graphics. Therefore, a merging of technologies has become necessary in order to present such complex data information in a useable form-factor.

The merger of wireless technologies such as cellular and paging systems with a visual interactive display system of a portable nature, such as a PDA, is becoming increasingly more accepted and prevalent in the market place. It is known, that a PDA may interface with a cradle or other receiving device having wireless receiving and/or transmitting capability. Such combination devices traditionally provide a holster or cradle receiving device into which the PDA is placed and also through which the PDA interacts to exchange baseband data. The holster or cradle device thereafter modulates or demodulates the baseband signal as received from the PDA into a suitable spectrum for interacting with a wireless hosting system. It is also well know that an integrated version of the above combination is also available wherein the receiving or transmitting capability is integrated within the PDA to provide a simplified functioning platform. One such device presently available is the PalmPilot VII as manufactured and sold by 3COM Corporation. Other such devices are also known and sold by other manufactures.

While such devices have become integrated (i.e., the receiving or transmitting circuitry has been incorporated or integrated within the PDA), it should be appreciated that the additional functionality of receiving and transmitting radio waves over a wireless channel requires the addition of an antenna apparatus to the PDA. Such configurations to date result in an antenna that significantly protrudes from the PDA. Furthermore, such antennas have heretofore been fixed by the manufacture in a specific location which may present a cumbersome interference to some users as it protrudes from the PDA.

It should be appreciated also that with the ubiquitous nature of PDAs, such devices are generally tailored to be more ergonomic to the majority-handed (ie., right-handed) users. In such configurations, antennas may be fixed by the manufacturer on one side of the device or the other depending on the manufacturer's choice and not the user's preference.

Therefore, it would be an advancement in the art to provide an antenna configuration for use in a PDA device which does not protrude in a cumbersome manner from the PDA. Such an improvement would not distract from the generally sleek ergonomics of a PDA.

Furthermore, it would also be an advancement in the art to provide an antenna interface for PDAs that allows the user to select a preferred placement of the antenna instead of a take-it-or-leave-it attachment as dictated by a PDA manufacturer.

BRIEF SUMMARY AND OBJECTS OF THE INVENTION

It is an object of the present invention to provide a flexible configuration for accommodating the relocation or configuration of an antenna for use in a wireless transceiver device such as a PDA.

It is another object of the invention to provide a flexible configuration to enable a user to relocate the antenna in a more convenient location such as to be either more convenient or less intrusive to the user.

It is a further object of the invention to provide a flexible user-selectable configuration wherein the user may relocate the antenna of a wireless transceiver device in accordance with the user's preference as dictated by the user's preference such as the user's dominant hand (i e., right handedness verses left handedness).

An apparatus for accommodating a user-selectable placement of an antenna for use in a wireless communication device, such as a personal data assistant device, is presented. The apparatus of the present invention comprises a user-removable antenna having a first end for indirectly coupling with a transceiver of the wireless device and, in the preferred embodiment, a second end for extending at least partially outside the wireless personal data system for facilitating the user-selectable placement of the user-removable antenna. The apparatus further comprises a plurality of receiving channels or slots within or at least partially within the personal data assistant for receiving therein a user-removable or relocatable antenna, as well as other user devices such as a stylus.

In order to facilitate the electrical connection between the wireless transceiver device's transceiver and the antenna, a plurality of electrically symmetrical transmission lines is also provided. Such transmission lines originate at the transmitter and have electrically compatible transmission line lengths to facilitate the propagation of the desirable electromagnetic wave from the transmitter to the receiving channel having the antenna received therein. The other transmission lines that are not coupled to the antenna are of such an electrical transmission line length to not induce interfering electromagnetic transmissions (e.g., interference) onto the transmission line coupling the antenna and the transceiver.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
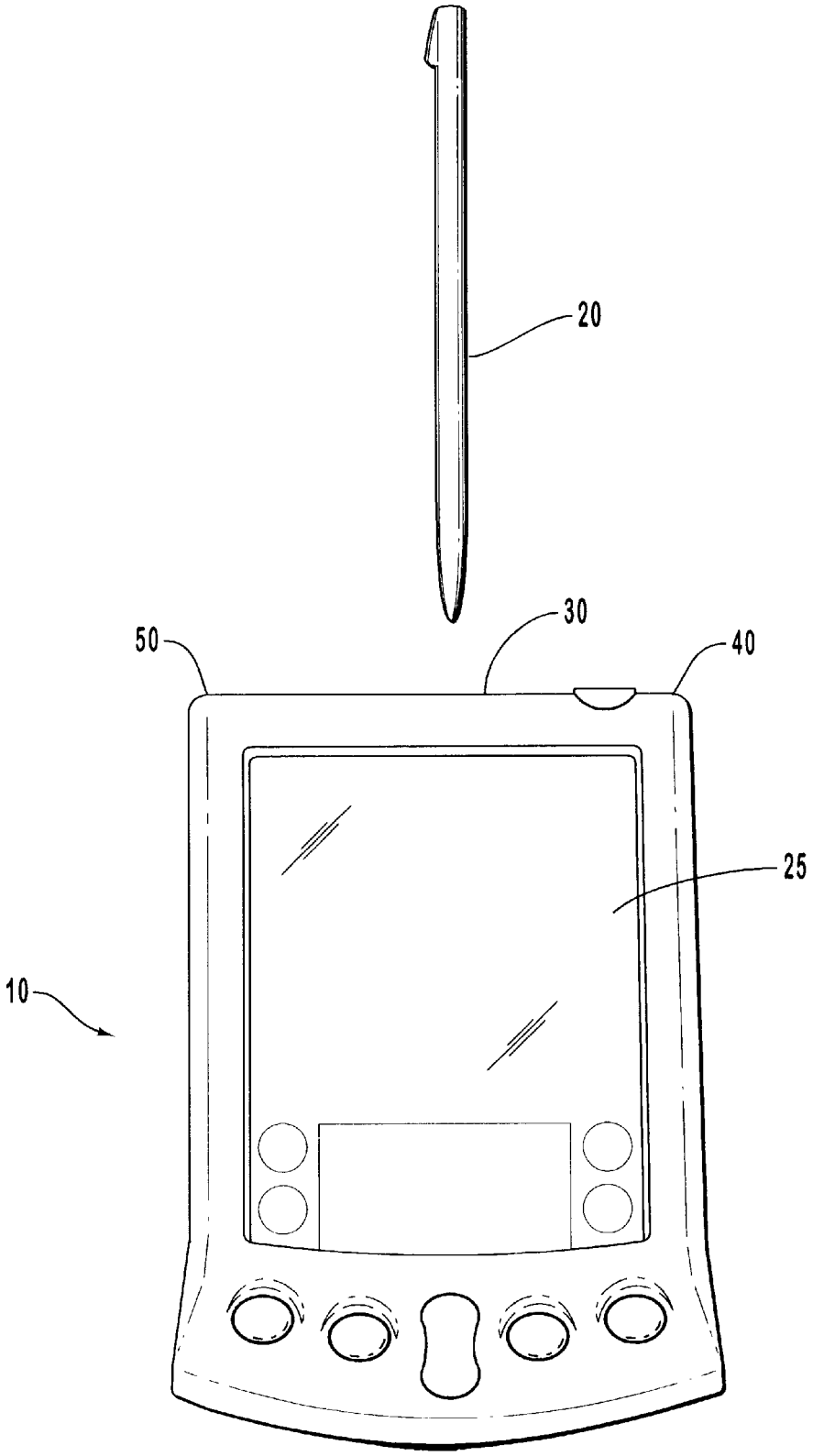
FIG. 1 is a diagram depicting a PDA and a stylus for use by a user for interacting with the PDA.

FIG. 1 is a diagram depicting a PDA and a stylus for use by a user for interacting with a PDA. A PDA 10, as depicted in FIG. 1, is a graphical interface device having an interface generally responsive to interaction by a user using a stylus 20 for exerting pressure upon the interactive display 25. Other interaction may be performed between a user and PDA 10 such as through the use of an electronic stylus or through the use of manual pressure exerted by, for example, a user's finger.

PDA 10 is further comprised of a PDA housing 30 which forms a general framework within which display 25 and various control circuitry, including a digital processor, memory, a power source, as well as other elements, generally known by those of skill in the art, to comprise a digital or electronic device such as PDA 10. It should also be pointed out that PDA 10 may take the form of other types of devices such as wireless transceiver devices, and may additionally have an extensive configuration of buttons or other interactive elements that facilitate interaction between a user and the device.

Since traditional PDAs are largely graphically interactive, a stylus 20 is the generally accepted interactive interface device of choice by users. As such, PDAs generally incorporate a storage mechanism for retaining a stylus therein. By retaining a stylus therein, the interactive stylus is generally made available to a user without the user separately storing or retaining the stylus device. FIG. 1 depicts an integrated first symmetrical receiving channel 40, depicted in greater detail in subsequent drawings, for receiving stylus 20 therein. A receiving channel may take various retention forms and in the preferred embodiment is generally cylindrical in shape for receiving the generally cylindrical stylus 20. In one embodiment of receiving channel 40, as depicted in greater detail in FIG. 2, the receiving channel takes the form of a cylindrical "C" -shape for enabling a user to visually see into the receiving channel and for facilitating uniquely shaped stylus or stylus-like accessories.

In an attempt to accommodate user preferences relating to the location of a receiving channel, FIG. 1 depicts a second symmetrical receiving channel 50 sized and shaped generally equivalent to first symmetrical receiving channel 40. By employing a plurality of receiving channels, the PDA accommodates the stowage of stylus 20 in either a right handed or left handed user configuration.

Figure 2:
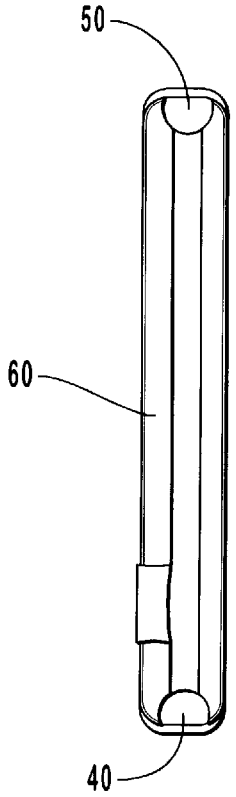
FIG. 2 is an end view drawing of a PDA illustrating the symmetrical storage channels for retaining the stylus on either side of the PDA, in accordance with a user's preference.

FIG. 2 depicts an end view drawing of a PDA illustrating the symmetrical storage or receiving channels capable of receiving therein a stylus device or, in the present invention, an additional device such as an antenna not shown in FIG. 2. In FIG. 2, the top end of PDA housing 60 illustrates the end view of first symmetrical receiving channel 40 and second symmetrical receiving channel 50. This figure depicts the preferred embodiment of receiving channels 40 and 50 as being generally cylindrical in shape and generally "C" -shaped in profile. It is anticipated that other profiles and shapes of receiving channels are equally useful and other forms of retention of a stylus and an antenna into each of the receiving channels is contemplated to be within the scope of the present invention. For example, other attachments such as magnetic, adhesive, clip-based retention, etc. as well as friction-based attachments are yet contemplated within the scope of the present invention. Furthermore, other stylus profiles are also contemplated within the scope of the present invention with a receiving mechanism corresponding or complimenting the stylus dimensions for receiving and retaining the stylus in a storage position.

Figure 3:
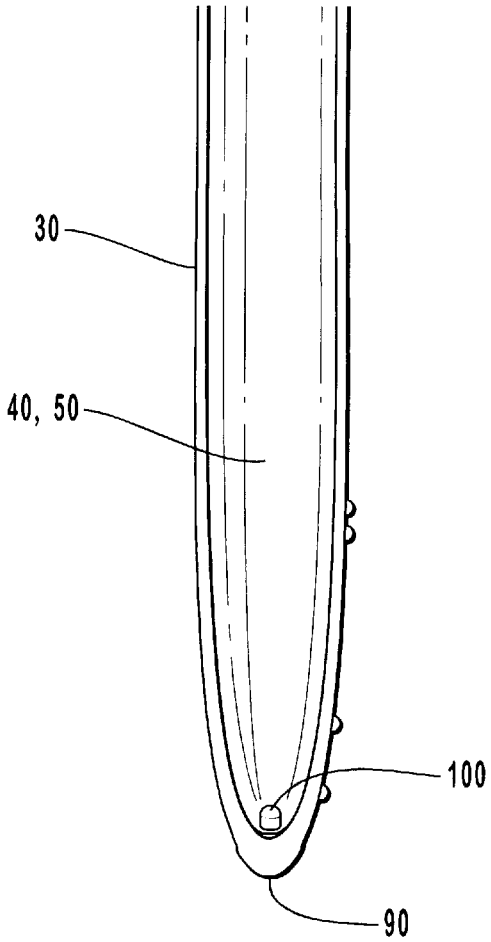
FIG. 3 depicts the termination stop of a PDA's receiving channel for receiving a stylus or an antenna therein.

FIG. 3 depicts the lower portion of an exemplary receiving channel in accordance with the preferred embodiment. FIG. 3 depicts PDA housing 30 with exemplary symmetrical receiving channels 40, 50. In the preferred embodiment, receiving channels 40, 50, while generally cylindrical in shape, have a termination point or end point attachment located at the bottom end of the PDA housing 90. Such a termination point or end in the case of a stylus functions merely as a stop for the stylus. In the present invention, a transmission line contact interface 100 provides a point or contact of attachment for an antenna and couples such an antenna to the transceiver of the wireless transceiver or PDA 10 (FIG. 1).

Transmission contact 100 provides the electrical interface between the antenna and the receiver and/or transmitter (transceiver) of the PDA. Transmission line contact interface 100 may take various forms including a spring contact-based interface, a friction or press-fit interface, a spring loaded or "pogo-pin" interface as well as other various interfaces known by those of skill in the art.

While the present and preferred embodiment depicts a transmission line contact interface as a terminal contact interface, (i.e., a contact interface formed by the insertion of an antenna terminating at the contact point), other contact interfaces are contemplated within the scope of the present invention. For example, the antenna may be configured to have contact points along the side or longitudinal portion of the antenna at a point other than the terminal end. In such an embodiment, the antenna would encounter a slide contact at a portion of the receiving channel other than the terminal end point. Furthermore, as the receiving channels depicted in FIG. 2 illustrate, the receiving channel may be largely open throughout the longitudinal direction thereby facilitating the press-fitting of an antenna into the receiving channel by placing the antenna external to the receiving channel in a longitudinal parallel arrangement and then pressing and snapping the antenna into the receiving channel which could further engage a contact interface with the PDA in a manner other than slide contacts or terminal/termination contacts. Those skilled in the art of such interfaces appreciate the myriad of alternative contact interfaces available, which are herein considered to be within the scope of the present invention.

Figure 4:
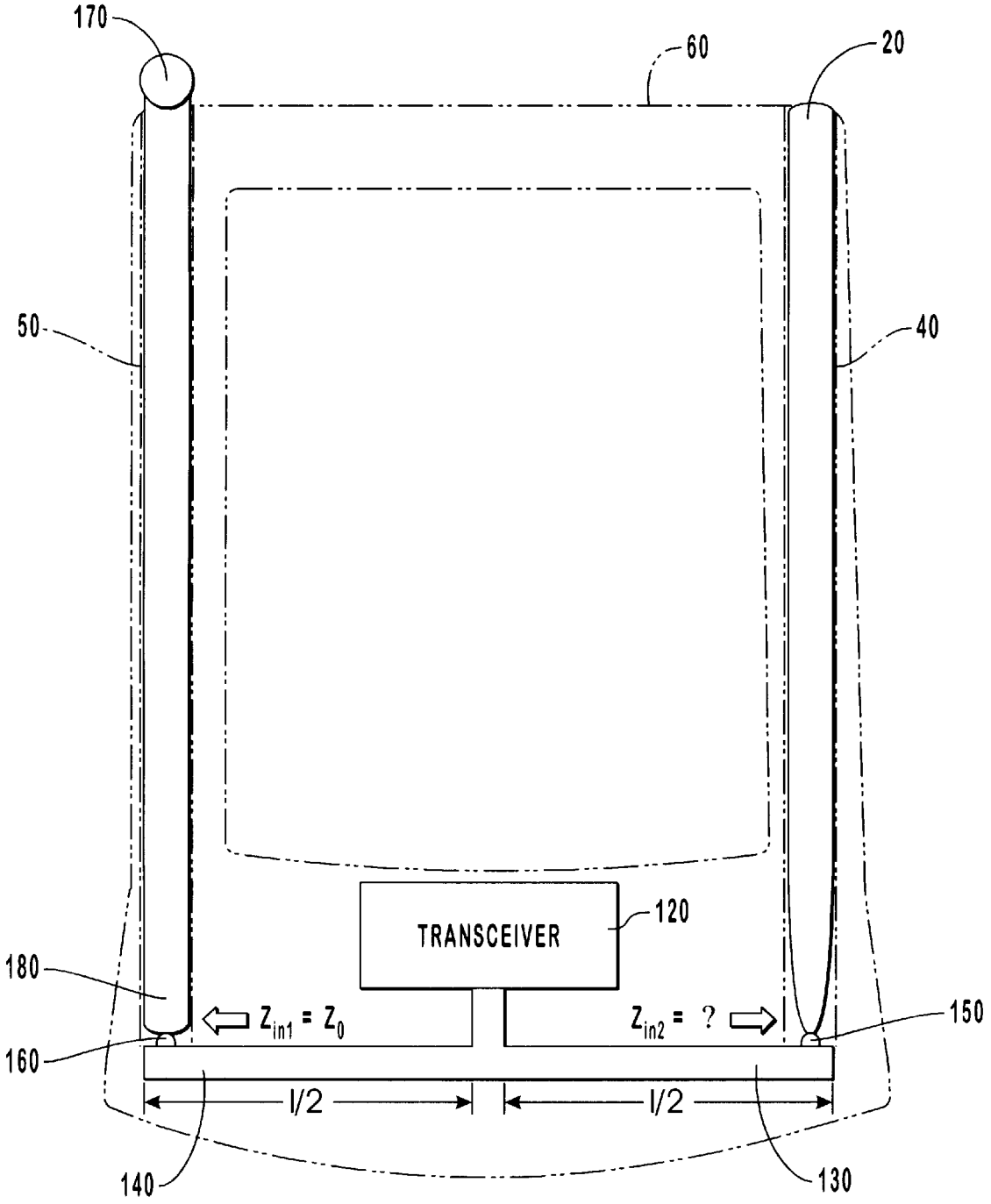
FIG. 4 depicts the layout of the routing of signals for transceiving at the PDA when the stylus and antenna load are arbitrarily retained in channels of the PDA.

FIG. 4 depicts a cut away electrical diagram illustrating the electrical feasibility of a user selectable relocation of an antenna within a PDA or wireless transceiver device as described herein. The PDA is generally shown, with the top end of the PDA housing 60 and symmetrical receiving channels 40 and 50 depicted generally. While the present figure depicts stylus 20 being received in first symmetrical receiving channel 40 and antenna 170 being received within second symmetrical receiving channel 50, it is essential to point out that such a configuration is only illustrative and the arrangement of the present invention depicts a symmetrical nature wherein stylus 20 and antenna 170 may be exchanged according to a user preference or other preferred configuration to be received into opposing receiving channels while preserving full functionality of the device.

FIG. 4 depicts a transceiver 120 which may take the form of a receiver wherein the PDA device is a receive only or "pager" device, or alternatively may take the form of a transmit-capable device. The present invention contemplates all such configurations both receive-only, and transmit/receive (transceive) configurations.

Those skilled in the art of transmission theory appreciate that the routing of electromagnetic signals from the transceiver to the antenna must be performed using transmission line theory guidelines. In accordance with such transmission line guidelines, FIG. 4 depicts a plurality of electrically symmetrical transmission lines, transceiver output transmission line 130 and transceiver output transmission line 140 which originate at transceiver 120 and terminate at a position conducive for interfacing with antenna 170. Again, it should be pointed out that antenna 170 while depicted in FIG. 4 as being received within symmetrical receiving channel 50, may equally be received within receiving symmetrical channel 40 without any impact to performance. FIG. 4 further depicts the electrically symmetrical configuration of transceiver output transmission lines such that an unloaded transmission line, in FIG. 4 transmission line 130, does not create interfering reflections either back to transceiver 120 or onto transceiver output transmission line 140 for contamination of the propagated electromagnetic field emanating from antenna 170. It should be reiterated that such a configuration is advantageous in order to preserve the integrity of the transceived signal from the PDA.

FIG. 4 further depicts the preferred embodiment of a transmission line contact interface by depicting transmission line contact interface 150 and 160 as being spring contact interfaces. It should be recalled that such spring-contact interfaces are only one contact interface from among many contact interfaces including those previously described. In the present contact interface, it is illustrated that antenna 170 is comprised of a terminal end 180 wherein, in the preferred embodiment, the interface between antenna 170 and transmission line contact interface 160 is performed.

A wireless personal data assistant or other wireless transceiver device having an improved apparatus for accommodating a user selectable placement of an antenna from among a plurality of possible placements of the antenna has been described. The advantages and benefits of a user selectable placement of an antenna in a more desirable configuration has been shown. Those skilled in the art appreciate the existence and possibilities of various permutations of receiving channel configurations and shapes as well as antenna and stylus configurations and shapes. Furthermore, the PDA or wireless transceiver device may take other specific embodiments such as computers or other handheld devices that employ wireless transceiving. Such varieties are contemplated within the scope of the present invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. In a wireless personal data assistant, an apparatus for accommodating a user-selectable placement of an antenna for use in wireless communications by said wireless personal data assistant, said apparatus comprising:

a) a user-removable antenna having a first end for indirectly coupling with a transceiver of said wireless personal data assistant and a second end for extending at least partially outside said wireless personal data assistant for facilitating said user selectable placement of said user-removable antenna;

b) a plurality of receiving channels integral with said wireless personal data assistant, said plurality of receiving channels each capable of receiving therein said user-removable antenna; and c) a plurality of electrically symmetrical transmission lines electrically coupled at a first end to said transceiver with a second end extending at least partially into a corresponding one of said plurality of receiving channels for electrical coupling with said user removable antenna, said plurality of electrically symmetrical transmission lines configured such that when said user-removable antenna is placed within one of said plurality of receiving channels and electrically coupled to one of said plurality of electrically symmetrical transmission lines, each other of said plurality of electrically symmetrical transmission lines exhibit infinite impedance to said transceiver.

2. The apparatus as recited in claim 1, wherein said plurality of receiving channels are further configured to receive for storage a stylus of said personal data assistant in at least one of said plurality of receiving channels.

3. The apparatus as recited in claim 2, wherein at least two of said plurality of receiving channels are symmetrically placed about said personal data assistant to enable ambidextrous placement of said user-removable antenna and said stylus.

4. The apparatus as recited in claim 2, wherein said second end extending at least partially into said plurality of receiving channels each further comprise transmission line contact interfaces for electrically interfacing with said user-removable antenna.

5. The apparatus as recited in claim 1, wherein said plurality of electrically symmetrical transmission lines have an electrical length approximating one-half wavelength of the frequency used by said wireless personal data assistant.

6. A wireless personal data assistant for accommodating a user-selectable placement of an antenna for use in wireless communications by said wireless personal data assistant, said wireless personal data assistant comprising:

a) a housing comprised of an interactive screen operably driven by a digital controller, said interactive screen for displaying digital data and responsive to interaction by a user via a stylus, said stylus for interacting with said interactive screen;

b) a transceiver operably coupled to said digital controller for performing transmit and receive functions over a wireless channel;

c) a user-removable antenna having a first end for indirectly coupling with said transceiver; and d) an apparatus electrically coupled to said transceiver for accommodating a user selectable placement of an antenna for use in wireless communications by said wireless personal data assistant, said apparatus comprising:

e) a plurality of receiving channels each capable of receiving therein said user-removable antenna; and f) a plurality of electrically symmetrical transmission lines electrically coupled at a first end to said transceiver with said second end extending at least partially into a corresponding one of said plurality of receiving channels for electrical coupling with said user removable antenna.

7. The wireless personal data assistant as recited in claim 6, wherein said plurality of electrically symmetrical transmission lines are configured such that when said user-removable antenna is placed within one of said plurality of receiving channels and electrically coupled to one of said plurality of electrically symmetrical transmission lines, each other of said plurality of electrically symmetrical transmission lines exhibit infinite impedance to said transceiver.

8. The apparatus as recited in claim 7, wherein at least two of said plurality of receiving channels are symmetrically placed about said personal data assistant to enable ambidextrous placement of said user-removable antenna and said stylus.

9. The apparatus as recited in claim 7, wherein said second end extending at least partially into said plurality of receiving channels each further comprise transmission line contact interfaces for electrically interfacing with said user-removable antenna.

10. The apparatus as recited in claim 6, wherein said plurality of receiving channels are further configured to receive for storage a stylus of said personal data assistant in at least one of said plurality of receiving channels.

11. The apparatus as recited in claim 6, wherein said plurality of electrically symmetrical transmission lines have an electrical length approximating one-half wavelength of the frequency used by said wireless personal data assistant.

12. In a wireless transceiver device, an apparatus for accommodating a user selectable placement of a user-removable antenna from among a plurality of possible antenna placements for use in wireless communications by said wireless transceiver device, said apparatus comprising:

a) a plurality of receiving channels configured about said wireless transceiver device, said plurality of receiving channels each capable of receiving therein said user-removable antenna;

b) a plurality of electrically symmetrical transmission lines electrically coupled at a first end to a transceiver of said wireless transceiver device with a second end extending at least partially into a corresponding one of said plurality of receiving channels for electrical coupling with said user removable antenna, said plurality of electrically symmetrical transmission lines configured such that when said user-removable antenna is placed within one of said plurality of receiving channels and electrically coupled to one of said plurality of electrically symmetrical transmission lines, each other of said plurality of electrically symmetrical transmission lines exhibit approximately infinite impedance to said transceiver.

13. The apparatus as recited in claim 12, wherein said plurality of receiving channels are further configured to receive for storage a stylus of said wireless transceiver device in at least one of said plurality of receiving channels.

14. The apparatus as recited in claim 13, wherein at least two of said plurality of receiving channels are symmetrically placed about said wireless transceiver device to enable ambidextrous placement of said user-removable antenna and said stylus.

15. The apparatus as recited in claim 13, wherein said second end extending at least partially into said plurality of receiving channels each further comprise transmission line contact interfaces for electrically interfacing with said user-removable antenna.

16. The apparatus as recited in claim 12, wherein said plurality of electrically symmetrical transmission lines have an electrical length approximating one-half wavelength of the frequency used by said wireless transceiver device.

* * * * *